United States Patent [19]

Madsen et al.

[11] 4,145,230

[45] Mar. 20, 1979

[54] METHOD FOR SEEDING SUPER-SATURATED SUGAR SOLUTION TO EFFECT CRYSTALLIZATION

[75] Inventors: Rud F. Madsen; Ernst Knøvl; Günther R. Møller; Werner K. Nielsen, all of Nakskov, Denmark

[73] Assignee: Aktieselskabet de Danske Sukkerfabrikker, Copenhagen, Denmark

[21] Appl. No.: 798,862

[22] Filed: May 20, 1977

[30] Foreign Application Priority Data

May 21, 1976 [DE] Fed. Rep. of Germany ..... 2269/76

[51] Int. Cl.[2] ..... C13F 1/02

[52] U.S. Cl. ..... 127/60; 127/15

[58] Field of Search ..... 127/60

[56] References Cited

U.S. PATENT DOCUMENTS 3,219,484 11/1965 Smythe ..... 127/60 X 3,642,534 2/1972 Cremoux ..... 127/60 X 3,695,932 10/1972 Randolph ..... 127/60 X

*Primary Examiner*—Sidney Marantz

*Attorney, Agent, or Firm*—Watson, Cole, Grindle & Watson

[57] ABSTRACT

A method for the seeding of a super-saturated sugar solution to effect a crystallization therein by adding to the solution finely milled sugar suspended in a suspension agent, said suspension being capable of being spread in the sugar solution and being stable for longer periods of time when being subjected to a slow flowing movement.

An apparatus for seeding a super-saturated sugar solution comprising a liquid conduit system and means for generating a continuous stream of a suspension of finely milled sugar crystals in a suspension agent and for injecting at desired intervals a dosed amount of suspension from a point in the liquid conduit system into the sugar solution to be crystallized.

4 Claims, 2 Drawing Figures

METHOD FOR SEEDING SUPER-SATURATED SUGAR SOLUTION TO EFFECT CRYSTALLIZATION

BACKGROUND OF THE INVENTION

This invention relates to a method for the seeding of a super-saturated sugar solution to effect a crystallization therein, said method comprising the step of adding to said solution finely milled sugar suspended in a liquid suspension agent which is wholly or partially soluble in water, which does not significantly dissolve sugar crystals and which has a boiling point which is higher than the temperature of the sugar solution to be crystallized.

In the commercial production of sugar the formation of sugar crystals is effected by a closely controlled crystallization process. In most cases the crystallization is effected discontinuously in special boilers in which a purified and concentrated sugar syrup is further concentrated by evaporation of water. The boiling is effected in a closed container under vacuum and at a temperature within the range 65°–85° C. Normal boilers contain from about 25 to 150 tons of massecuite (a mixture of crystals and syrup).

During the boiling operation the sugar concentration is increased and is brought into the super-saturated zone. The crystal formation is then initiated by seeding the super-saturated solution with an exact amount of finely milled sugar crystals.

These crystals which are formed by milling ordinary sugar so as to obtain a particle size of between 5 and 20 μm constitute nuclei for the formation of new crystals in the super-saturated solution.

During the subsequent continuous controlled boiling step under which additional fresh syrup is introduced, these crystals grow. When the crystals have reached the desired particle size the massecuite is discharged from the apparatus and the crystals are separated from the syrup (green syrup or molasses) by being centrifuged.

The size of the final sugar crystals depends on the crystallization time and the number of crystals formed and it is attempted to obtain the same volume and the same crystal percentage at the end of each boiling operation.

The finely milled sugar crystals used as seeds are normally added suspended in an alcohol such as isopropanol which has a boiling point higher than the temperature of the sugar solution to be cystallized.

The addition of an exact amount of seeds is effected when a predetermined super-saturation has been obtained, and the addition is effected once per cycle.

The seeding with a suspension of finely milled sugar in isopropanol so as to obtain a predetermined number of crystals presents some practical difficulties.

Thus a suspension of finely milled sugar in isopropanol is very unstable, and it should, therefore, be maintained under constant vigorous stirring so as to avoid sedimentation. When weighing and preparing such a suspension an evaporation of the isopropanol takes place and consequently part of the milled sugar is deposited in the container and on the valves and therefore does not participate in the crystal formation. The result is that varying amounts of crystal nuclei are added when using the same amount of sugar suspension based on volume or weight. Furthermore a suspension of finely milled sugar in isopropanol is not suitable for pumping due to the sedimentation of sugar.

The object of the invention is to eliminate or reduce the drawbacks of the prior art technique.

SUMMARY OF THE INVENTION

This object is obtained by the method of the invention, which method is characterized in that it comprises the use of a suspension agent and an amount of finely milled sugar such that the suspension obtains a viscosity which is sufficiently low to permit that the suspension can be spread in the sugar solution to be crystallized and sufficiently high to form a suspension which is stable for longer periods when being subjected to a slow flowing movement.

When using a sugar suspension as seeding material, the amount of suspension agent should be as low as possible. Therefore it is desirable to use a sugar suspension having the highest possible concentration of crystals. High concentrations of crystals also tend to increase the viscosity of the suspension and consequently to reduce the sedimentation of crystals. On the other hand suspensions comprising relatively viscous suspension agents and having high concentrations of crystals are difficult to handle because the viscosity of such suspensions increases exponentially with increasing concentrations of crystals.

When seeding super-saturated saccharose solutions having a viscosity within the range 400–1000 cp, it has been found that in order to obtain a uniform distribution of crystals the suspensions should have a viscosity within the range of from about 200 to 600 cp.

As will appear from the following table I which sets forth viscosity data for different suspensions as a function of the concentration of crystals, the desired viscosity of the suspension is obtained by using polyethylene glycol 200 having a concentration of crystals of between 40 and 50% or polyethylene glycol 600 having a concentration of crystals of from 30 to 40% as suspension agent.

Table I also shows that even at a concentration of crystals of 50% a suitable viscosity of the suspension cannot be obtained when using isopropanol as suspension agent.

Other polyglycols such as polypropylene glycol and other highly viscous liquids or mixtures of liquids having viscosity data corresponding to those of the above mentioned polyethylene glycols can also be used in the method of the invention by suitably adjusting the concentration of crystals.

Polyethylene and polypropylene glycols present the advantage that they do not change the properties of the molasses.

Table I

| Finely milled saccharose, % | Viscosity measured at 25° C. for saccharose suspensions — Suspension agent: Isopropanol | | Polyethylene glycol 200 | | Polyethylene glycol 600 | |
|---|---|---|---|---|---|---|
| 0 | 2,3 | cp | 50 | cp | 115 | cp |
| 10 | 3,0 | - | 65 | - | 141 | - |
| 20 | 4,0 | - | 82 | - | 185 | - |
| 30 | 5,1 | - | 116 | - | 268 | - |

Table I-continued

| Finely milled saccharose, % | Viscosity measured at 25° C. for saccharose suspensions — Suspension agent: Isopropanol | | Polyethylene glycol 200 | | Polyethylene glycol 600 | |
|---|---|---|---|---|---|---|
| 40 | 8,1 | - | 225 | - | 578 | - |
| 50 | 16,2 | - | 475 | - | 1730 | - |
| 55 | | | 1260 | - | 4956 | - |
| 60 | | | 2475 | - | | |

When selecting a suspension agent the viscosity of pure pure suspension agent plays an important role as will appear from the above data, because as indicated above it is not feasible to use very high concentrations of crystals.

Reference is also made to the following table II which sets forth the viscosities of some alcohols and polyglycols measured at 20° C.

Table II

| Viscosity data for some alcohols and polyglycols at 20° C. | | |
|---|---|---|
| Isopropanol | 2,38 | cp |
| Tertiary butyl alcohol | 4,21 | - |
| 1-butanol | 3,21 | - |
| Polyethylene glycol 200 | 59,4 | - |
| Polyethylene glycol 400 | 115,0 | - |
| Polyethylene glycol 600 | 173,9 | - |
| Polypropylene glycol 425 | 94,0 | - |
| Polypropylene glycol 1025 | 200,0 | - |
| Polypropylene glycol 2025 | 444,0 | - |

In order to increase the number of crystals in the suspension it is preferably milled in a ball mill comprising steel balls. In this manner the necessary dosage amount can be reduced because the number of nuclei per weight unit is increased. Furthermore the milling in such a ball mill produces a more uniform seeding material.

The invention also relates to an apparatus for carrying out the above mentioned method. The apparatus of the invention is characterized in that it comprises a liquid conduit system and means for generating a continuous stream of suspension in said liquid conduit system and for injecting at desired intervals a dosed amount of suspension from a point in the liquid conduit system into the sugar solution which is to be crystallized.

The apparatus of the invention is based on the utilization of the property of the suspension that it can be maintained stable for longer periods by subjecting it to a slow flowing movement in the liquid conduit system until the time at which a dosed amount of suspension is to be injected.

DESCRIPTION OF THE PREFERRED EMBODIMENTS

Figure 2:
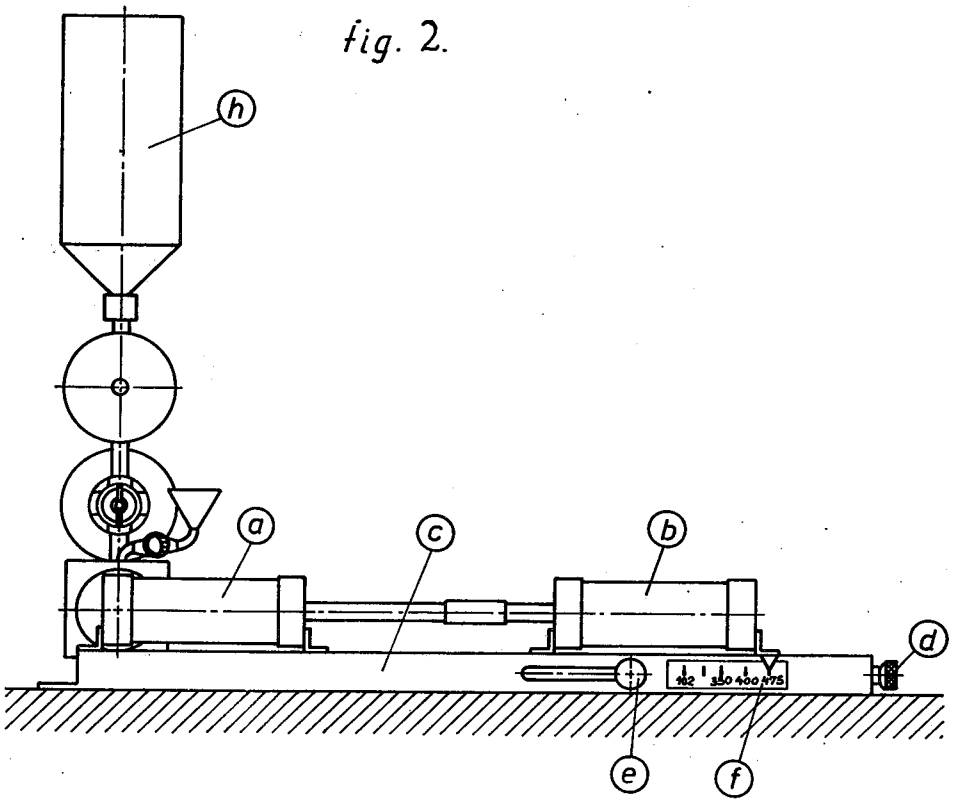
FIGS. 1 and 2 schematically illustrate an embodiment of the apparatus of the invention in two vertical projections which are perpendicular to one another.
Figure 1:
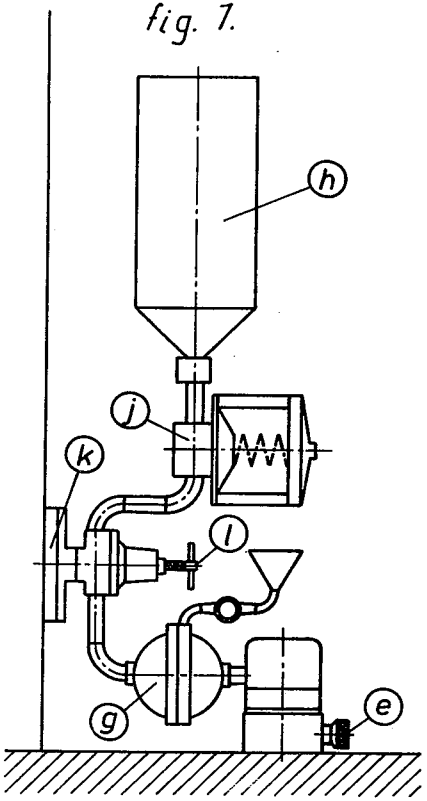

The apparatus illustrated in FIGS. 1 and 2 comprises a pair of compressed air cylinders a and b having piston rods which are coupled together and being mounted on a frame c. The cylinder a is fixed to the frame c, whereas the cylinder b is mounted in a manner so that it can be displaced in its longitudinal direction. The displacement is effected by means of a spindle d and during operation the cylinder b is locked by a screw e.

The cylinder b is connected to a source of compressed air and compressed air is alternatingly supplied to one and the other end of the cylinder b. In this manner the piston of the cylinder b and consequently also the piston of the cylinder a are caused to move forwards and backwards. By changing the location of the cylinder b relative to that of the cylinder a the stroke volume of the cylinder a can be changed from 0 to the full volume of the cylinder. The magnitude of the stroke volume is indicated by a scale f provided on the frame c.

The stroke volume of the cylinder a is utilized to measure a desired amount of seeding material. Since the seeding material tends to adhere to the parts of the apparatus and since the sugar crystals have an abrasive effect, the sugar is kept out the cylinder by using a diaphragm device g consisting of a rubber diaphragm and two metal cups bolted together along the periphery of said diaphragm. The other side of the diaphragm device g is connected to the cylinder a. The diaphragm device g and the cylinder a are filled with oil. When the piston in the cylinder a is moved, the diaphragm in the diaphragm device g is moved corresponding to the stroke volume.

The seeding material (suspension) is added to a container h which acts as a reservoir. From the bottom of the container h the suspension is passed through an automatic valve j, and a special back pressure valve k which is mounted directly on the side of the boiler and further on to the diaphragm device g.

The valve k consists of a rubber cone which can be brought into contact with a flange on the boiler. A valve spindle connected to a rubber diaphragm is held in place by a coil spring, the pressure of which may be adjusted by an adjusting screw 1.

The apparatus shown is also suitable for pumping highly viscous suspensions.

The operation of the apparatus illustrated is following:

The container h is filled with the suspension to be introduced into the boiler and the compressed air cylinder b is activated by supplying compressed air alternatingly to one end and the opposite end of said cylinder. In this manner a pumping movement is started, said pumping movement serving to pump suspension out from and into the container h containing the suspension.

Shortly before the seeding material is to be introduced the pumping movement is stopped in the extreme position in which the diaphragm device is filled with seeding material. After a short period the automatic valve j is closed and during the seeding the piston of the cylinder b starts to move towards the opposite end of the cylinder. Since the valve j is closed, the pressure exerted on the diaphragm of the valve k increases so as to open the valve k and to inject seeding material into the boiler. After a short delay the valve j is reopened and the pumping movement is resumed.

The apparatus illustrated fulfils the following the requirements:

1. The seeding material can be dosed in predetermined amounts with a great accuracy.
2. The dosage amount can be varied.
3. The suspension is kept out of contact with such parts of the apparatus which are susceptible to abrasion.
4. The apparatus generates a movement of the suspension which is sufficient to ensure that no sedimentation takes place in an amount of suspension which corresponds to a consumption within at least 24 hours.
5. The apparatus can be controlled automatically and the suspension can be dosed without manual regulation.

In connection with the above explanation it should be pointed out that instead of using a cylinder which is longitudinally displacable, both cylinders may be fixed to the frame provided the mechanical coupling between the pistons is longitudinally adjustable.

A further embodiment of the dosing apparatus comprises two or three bellows, one bellow holding the suspension agent, whereas the pumping movement is effected by introducing compressed air into the two remaining bellows. Alternatively only one further bellow is used and a coil spring is used to generate the return movement. The stroke volume of the apparatus is determined by adjusting the travel distance of the bellows.

The method of the invention will now be described in further detail with reference to the following example.

A suspension of 200 g finely milled saccharose contained in 250 g polyethylene glycol 200 having a viscosity of 475 cp was added to a boiler having a capacity of 50 tons. In a comparison test 250 g finely milled saccharose were added in normal manner. The results of two boiling processes in which the seeding was effected as indicated above are summarized in the following table III, which sets forth the particle size, spreading and the concentration of conglomerates.

TABLE III

| | 250 g finely milled sugar in 250 g polyethylene glycol 200 | 250 g finely milled sugar |
|---|---|---|
| Particle size | 0,51 mm | 0,54 mm |
| Spreading | 0,13 - | 0,13 - |
| Conglomerates | 18% | 20% |

We claim:

1. A method for the seeding of a super-saturated sugar solution to effect a crystallization therein, said method comprising the step of adding to said solution finely milled sugar suspended in a liquid which is wholly or partially soluble in water, which does not significantly dissolve sugar crystals and which has a boiling point which is higher than the temperature of the sugar solution to be crystallized, the suspension agent and the amount of suspended fine crystallized sugar being such that the viscosity of the suspension is sufficiently low so as to permit the suspension to spread in the sugar solution to be crystallized and sufficiently high so as to form a suspension which is stable for longer periods when being subjected to a slow flowing movement.

2. A method according to claim 1, wherein the suspension agent is a polyethylene glycol.

3. A method according to claim 1, wherein the suspension agent is a polypropylene glycol.

4. A method according to claim 1 wherein the suspension is milled in a ball mill comprising steel balls.

* * * * *